US005980678A

United States Patent [19]

Tselesin

[11] Patent Number: 5,980,678

[45] **Date of Patent: *Nov. 9, 1999**

[54] PATTERNED ABRASIVE MATERIAL AND METHOD

[75] Inventor: Naum N. Tselesin, Atlanta, Ga.

[73] Assignee: Ultimate Abrasive Systems, L.L.C., Atlanta, Ga.

[ * ] Notice: This patent is subject to a terminal disclaimer.

[21] Appl. No.: 09/075,188

[22] Filed: May 11, 1998

Related U.S. Application Data

[63] Continuation of application No. 08/728,169, Oct. 9, 1996, Pat. No. 5,817,204, which is a continuation of application No. 08/291,924, Aug. 18, 1994, abandoned, which is a continuation-in-part of application No. 08/066,475, May 25, 1993, Pat. No. 5,380,390, which is a continuation-in-part of application No. 07/712,989, Jun. 10, 1991, abandoned.

[51] Int. Cl.[6] ..... B44C 1/165

[52] U.S. Cl. ..... 156/230; 156/276; 156/279; 427/272; 427/282

[58] Field of Search ..... 156/230, 276, 156/279; 427/272, 282, 287

[56] References Cited

U.S. PATENT DOCUMENTS

| | | | |
|---|---|---|---|
| 2,268,663 | 1/1942 | Kuzmick | 51/206 |
| 2,811,960 | 11/1957 | Fessel | 125/15 |
| 2,876,086 | 3/1959 | Raymond | 51/298 |
| 3,127,715 | 4/1964 | Christensen | 51/206 |
| 3,276,852 | 10/1966 | Lemelson | 51/298 |
| 3,860,400 | 1/1975 | Prowse et al. | 51/293 |
| 4,317,660 | 3/1982 | Kramis et al. | 51/295 |
| 4,680,199 | 7/1987 | Vontell et al. | 427/199 |
| 4,720,317 | 1/1988 | Kuroda et al. | 156/250 |
| 4,776,885 | 10/1988 | Nakagawa et al. | 75/229 |
| 4,825,539 | 5/1989 | Nagashima et al. | 29/848 |
| 4,925,457 | 5/1990 | deKok et al. | 51/293 |
| 4,949,511 | 8/1990 | Endo et al. | 51/295 |
| 5,021,204 | 6/1991 | Frost et al. | 264/630 |
| 5,049,165 | 9/1991 | Tselesin | 51/295 |
| 5,092,910 | 3/1992 | de Kok et al. | 51/295 |
| 5,110,384 | 5/1992 | Dudek et al. | 156/89.17 |
| 5,131,924 | 7/1992 | Wiand | 51/293 |
| 5,380,390 | 1/1995 | Tselesin | 158/230 |
| 5,817,204 | 10/1998 | Tselesin | 156/230 |

FOREIGN PATENT DOCUMENTS

| | | |
|---|---|---|
| 0 086 086 | 8/1983 | European Pat. Off. . |
| 0 238 434 | 9/1987 | European Pat. Off. . |
| 0 294 198 | 7/1988 | European Pat. Off. . |
| 2 029 390 | 10/1970 | France . |
| 0 565 870 | 12/1985 | France . |
| 59-024965 | 2/1984 | Japan . |

*Primary Examiner*—James Sells

*Attorney, Agent, or Firm*—Finnegan, Henderson, Farabow, Garrett, & Dunner, L.L.P.

[57] ABSTRACT

A composite abrasive material is formed by coating a mesh-type material substrate with an adhesive, contacting the substrate with a quantity of hard, abrasive particles, then removing all particles not held by the adhesive within the openings of the mesh-type material. The particles are surrounded with a sinterable matrix material while the particles are temporarily held by the adhesive. The substrate can have the adhesive applied in a pattern, or covering uniformly to cause the particles to adhere in certain areas to achieve a desired pattern. While the particles are held on the substrate, physical force can be applied to orient the particles uniformly; then, a powder can be applied, or the substrate can be applied to a preform. Subsequent treatment with heat and pressure will complete the composite abrasive material.

62 Claims, 2 Drawing Sheets

PATTERNED ABRASIVE MATERIAL AND METHOD

This application is a continuation of application Ser. No. 08/728,169 filed Oct. 9, 1996 U. S. Pat. No. 5,817,204 which is a continuation of application Ser. No. 08/291,924 filed Aug. 18, 1994 abandoned which is a continuation-in-part of application Ser. No. 08/066,475 filed on May 25, 1993 and is now U. S. Pat. No. 5,380,390, which is a continuation-in-part of application Ser. No. 07/712,989 filed on Jun. 10, 1991 and is now abandoned.

BACKGROUND OF THE INVENTION

1. Field of the Invention

This invention relates generally to abrasive materials, and is more particularly concerned with a method for making a patterned abrasive materials wherein a plurality of abrasive particles is temporarily held by an adhesive, and is subsequently fixed by a matrix material.

2. Discussion of the Prior Art

Much effort has been expended in attempting to place diamonds or other hard abrasive particles on a surface in a predetermined pattern. The pattern is desirable in that the hard particles are distributed substantially uniformly throughout a surface, or in that specific shapes containing generally uniformly distributed particles are distributed throughout a surface. By having the particles in specific shapes that are distributed across a surface, the stock removal rate, and the quality of the machined surface, can be optimized; and, more importantly, spaces between the abrasive areas allow for the removal of debris and the inflow of coolant.

Most of the prior art techniques for providing patterns of abrasive particles include the provision of metal spots onto which diamonds are electrodeposited, the diamonds then being held in place by electroplating, or by a polymeric resin or the like. Diamonds have also been hand placed to achieve a pattern. Hand setting is of course very time consuming; and, the particles have then been held in place by electrodeposition of metal to hold the particles. Holding the particles by electrodeposited metal is not fully satisfactory because insufficient metal can be provided to truly hold the particles and to resist wear; thus, the particles tend to come loose before the abrasive material has been used enough to wear the particles. Once one stone, or particle, is loosened, there is less support for adjacent particles, and one is likely to lose a number of additional particles very quickly. In addition, not all hard particles can be held by electrodeposited metal; and, electrodepositing is limited in its range of metallic compositions as not all metals are capable of electrodeposition. Electrodepositing is not feasible with non-metallic compositions. Further, electrodepositing presents some environmental problems related to disposing of the used electrolytes.

Another prior art technique is disclosed in French application No. 69.01577, filed Jan. 24, 1969, and published under No. 2,029,390. In this application, abrasive particles are deposited into the openings in mesh material of wire, plastic or the like. While the abrasive particles reside in the openings in the mesh, metal is electroplated to secure the particles within the mesh. In one embodiment, the particles are forced into the openings in the mesh, and the mesh holds the particles until metal is electroplated thereon to secure the particles. To use this invention, therefore, one must select the size of the abrasive particles carefully; then, the electroplating does not provide sufficient strength for the resulting material to be very durable. This method is difficult to implement on a mass-production scale because the particles are not secured within the openings until metal is electrodeposited on the material, so the material would be difficult to transport before the metal is deposited.

One successful technique for providing patterns in the abrasive material is disclosed in U. S. Pat. No. 4,925,457, issued May 15, 1990, No. 5,049,165, issued Sep. 17, 1991, and No. 5,092,910, issued Mar. 3, 1992. This technique provides single and multiple layer sintered abrasive material that can subsequently be cut to shape and fixed to a substrate. Use of sinterable material, preferably processed with pressure during sintering, allows one to provide the abrasive tool with a desired combination of strength, flexibility, toughness, wear resistance, and good adherence to metallic mesh and to a variety of abrasive particles such as diamonds and cubic boron nitrides, for structural integrity. Because of this, very demanding applications can be satisfied, such as saw segments for cutting concrete, ceramic and stone, for stock removal members of grinding tools, and drill bit segments for the same materials. These materials and tools are used for such heavy duty applications as dry cutting. Electrodeposited metal does not have these advantages. If desired, of course, a plurality of specific shapes can be spaced apart on a substrate to achieve a patterned abrasive. The resulting patterned abrasive is a good quality abrasive, but the additional steps of preparing the abrasive, transporting the prepared abrasives within a manufacturing facility or between manufacturing facilities, and subsequently assembling the patterned abrasive renders the technique uneconomical for mass production of the abrasive material, and for some applications.

SUMMARY OF THE INVENTION

The present invention provides a method for making an abrasive material wherein a tacky adhesive is provided on a mesh-type or cellular substrate material. Hard abrasive particles are then placed in contact with the substrate, and the adhesive temporarily holds some of the hard particles within the openings in the substrate. The mesh-type or cellular substrate may take the form of a mesh. The mesh-type material will determine the distribution of the hard particles; and, the hard particles may be received within the openings of a mesh-type material. Alternatively, the adhesive may be applied in a pattern on the mesh-type substrate to determine the distribution of the hard particles.

After the hard particles have been placed on and adhered to the substrate, a sinterable matrix material is engaged with the hard particles and/or the substrate. The sinterable material is then sintered, preferably under pressure. The sintered matrix material thus provides a composite abrasive material wherein the particles are in the desired pattern and held by the sintered matrix material.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
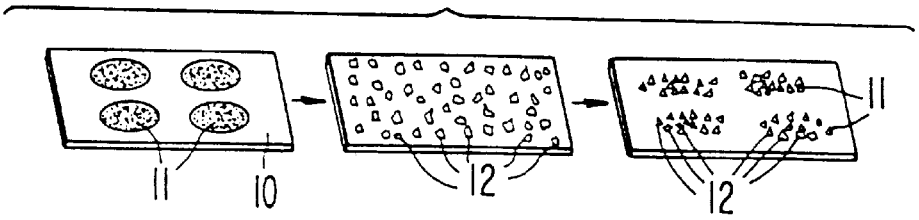
FIG. 1 is a rather schematic, perspective view showing one method for preparing an abrasive product in accordance with the present invention.

Referring now more particularly to the drawings and to those embodiments of the invention here chosen by way of illustration, FIG. 1 shows one technique for applying hard, abrasive particles to a substrate. The substrate 10 may be almost any mesh-like or cellular material, such as: a woven or non-woven metallic, ceramic, organic, glass, fiber graphite, fiber glass or fiber composition having regular or random openings or a thin sheet of metal with perforations, a mesh material, such as a cellular material, for instance, a wire mesh or a polymeric mesh, or any punched, drilled or expanded substrate, such as metal, ceramic, glass or organic, or a foil, plastic or paper with various shaped openings; or a preform consisting of unsintered, partially sintered or completely sintered metal powder, metal fibers, ceramic powder or mixtures thereof. In general, almost any substance may be used as the substrate 10, including a substrate made by vapor deposition, by thermal spraying such as plasma spraying, or the like, which has openings to receive the hard particles.

The first step in FIG. 1 shows the substrate 10 with a plurality of adhesive areas 11 defined thereon. The adhesive areas 11 may be formed in any way desired. For example, the surface of the substrate 10 can be masked as by a stencil, and the areas sprayed, poured or the like. Also, the areas 11 may be pieces of a heat sensitive or pressure sensitive tape, film or the like having an adhesive or is made tacky on at least one of its surfaces. Examples of such materials include 3M Scotch brand adhesive products, thermoplastic films, such as an ethylene vinyl acetate film which is heat sensitive and becomes tacky at elevated temperatures. Thus, any means for rendering the areas 11 tacky is within the scope of the present invention. The use of "pressure sensitive adhesive tape", unless indicated otherwise, shall be interpreted to include any of these tacky materials as the adhesive.

Brazing, or fusing, paste can be advantageously used as the adhesive in the present invention. The paste is available with and without flux. The paste is commercially available, and can also be custom made to suit individual preferences. Such a paste therefore will provide the adhesive, and a fusible material at the same time. It should also be understood, of course, that such a paste may contain sinterable material rather than a fusible material, or may contain both fusible and sinterable materials.

The second step in FIG. 1 then shows the substrate 10 contacted by a plurality of hard particles, the idea being to cover the entire substrate with the particles. Then, the substrate is inverted or otherwise treated to remove loose particles from the substrate. While particles 12 cover the entire substrate 10 in step two, step three shows particles 12 remaining only in the tacky areas 11. The material is thus ready to receive a matrix material to secure the particles 12 permanently.

Figure 2:
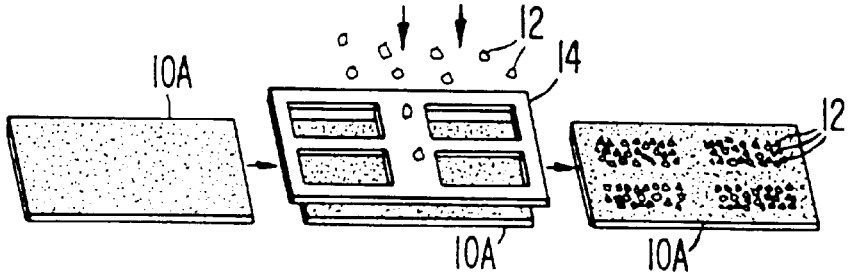
FIG. 2 is a view similar to FIG. 1, but showing a slightly modified process.

FIG. 2 shows a modification of the method illustrated in FIG. 1. In FIG. 2, the entire substrate 10A is coated with adhesive. Since the entire surface is coated, it will be understood that the adhesive may be sprayed, rolled, brushed or the like, or the substrate may be dipped, or tapes having adhesive thereon may be used. By some technique, then, the surface of the substrate 10A is coated with a tacky adhesive.

The substrate is a mesh-type material and may be a wire mesh. Adhesive is applied to the mesh-type material before the hard particles are engaged with the surface of the mesh material. The mesh will retain particles within the openings of the mesh that adhere to the adhesive.

As shown in FIG. 2, in a second step a mask is placed against the surface of the substrate 10A opposite the surface coated with the adhesive. Mask 13 has relatively large openings through which the particles 12 will pass to create areas of particles adhered to the substrate 10A. Mask 13 is then removed, as shown in step three of FIG. 2, and there remains a mesh-type substrate with a plurality of discrete areas, each having a plurality of particles adhered thereto.

The present invention readily lends itself to the orientation of hard particles before the particles are permanently secured. Using mechanical forces, such as by shaking or vibrating the substrate with the hard particles temporarily fixed by adhesive, or loose on the substrate, the particles will be forced into a position that is stable. The particles will be oriented within the openings of the mesh-type material. By applying magnetic force, the particles such as diamonds will become oriented according to their crystallographic structure and the lines of magnetic force. Thus, many different physical forces may be applied to the mesh-type substrate having hard particles therein, and the particles will be uniformly oriented.

Once the particles are oriented, they must be held securely in order to obtain the advantages of the orientation. After the particles have been oriented, therefore, the group of particles may be sprayed with a coating of an adhesive in addition to the adhesive on the mesh-type material to hold the particles in position. Also, one can wet the particles with a liquid such as water, then freeze the liquid to hold the particles. In any event, one will contact the particles with a sinterable material, which may be in the form of preform, metal powder, metal fibers, ceramic powder, ceramic fiber or mixtures thereof to provide upon sintering a permanent hold for the particles.

Figure 3:
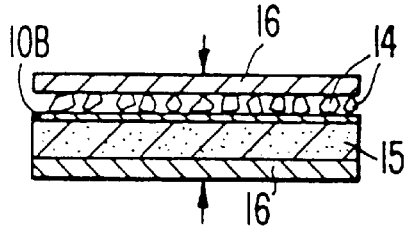
FIG. 3 is an enlarged, cross-sectional view showing the material from FIG. 1 or FIG. 2 being fixed by matrix material in accordance with the present invention.

Attention is next directed to FIG. 3 of the drawings which shows one method for securing the particles with a mesh-type matrix material. In FIG. 3 there is a substrate 10B which may be any mesh-type material. It should further be noticed that the adhesive may be a tape or the like having adhesive on both sides. The tape can then be stuck to the preform 15, and receive particles 14 on the other surface. Substrate 10B may be a rigid material that is subsequently placed against the preform 15. In any event, substrate 10B is placed against the preform 15, and pressure is exerted by the opposed plates 16.

When pressure is exerted on the assembly shown in FIG. 3, the particles 14 will be urged into the preform. One might force the particles 14 completely into the preform so the particles are totally surrounded by the matrix material, or one might leave a portion of the particles protruding from the preform. This is a matter of design choice depending on the particular use of the resulting abrasive material.

Those skilled in the art will understand that the preform 15 may be any of numerous types of preform. First, it should be pointed out that the preform should be a sinterable material. The final strength of the abrasive material will determine the particular sinterable matrix material selected for use.

Looking next at FIG. 4 of the drawings, it will be seen that this is an arrangement utilizing the method discussed in connection with FIG. 2 in that a mesh-type material is placed against the substrate, and particles adhere to the exposed substrate.

Figure 4:
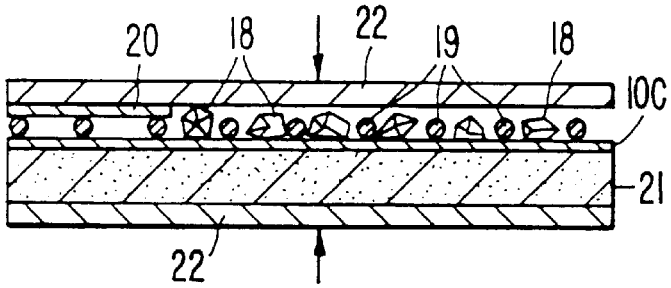
FIG. 4 is an enlarged, cross-sectional view showing a modified form of the arrangement shown in FIG. 3.

As shown in FIG. 4, the substrate 10C has an adhesive as has been previously discussed. The mesh-type material takes the form of a wire mesh 19. While the openings in the mesh of FIG. 2 are large enough that a large number of particles 12 enter each opening, the openings in FIG. 4 are such that a single particle 18 is in each opening. This is a matter of design choice, and any ratio of opening size to particle size may be selected.

Another feature shown in FIG. 4 is the blocking, or shielding, of a portion of the mesh 19. Some form of shield 20 can be used to cover a portion of the mesh 19 and adhesive to prevent particles 18 from adhering in this area. Though numerous materials and techniques can be used, if one is using a heat sensitive or pressure sensitive tape or film as the adhesive, the same tape or film can be used as the shield 20, so the completed mesh is easy to assemble.

FIG. 4 shows an arrangement similar to FIG. 3 in that the substrate 10C, with the temporarily adhered particles 18, is placed against a preform 21, and plates 22 then exert pressure on the assembly. A difference in FIG. 4 is that the mesh 19 remains in place to be forced into the preform. The mesh 19 may be a steel or other relatively high melting point metal, in which case the mesh will assist in supporting the particles 18 during use of the resulting abrasive material; or, the mesh 19 may be a polymeric or metallic material or the like having a low melt or vaporization point, in which case the mesh will effectively or partially disappear from the completed abrasive material when sintered. When a mesh-type material is used as a substrate and if it is a material having a melting point and/or vaporization temperature lower than the sintering temperature, such as a polymeric or a low melting metallic material, for instance, zinc, brass or bronze, it will disappear or at least partially dissolve in the sinterable matrix material in the process of sintering at the sintering temperatures.

As before, the particles 18 can be forced completely into the preform 21, or the particles may be partially protruding from the preform to have an "open" surface immediately.

Using the process of the present invention, the ratio of the size of the mesh opening to the size of the hard particles is not important. During the compaction of the sinterable material, the particles can be separated by the sinterable matrix material so that substantially all the particles can be substantially completely surrounded by matrix material and are not directly in contact with wires of the mesh material.

Figure 5:
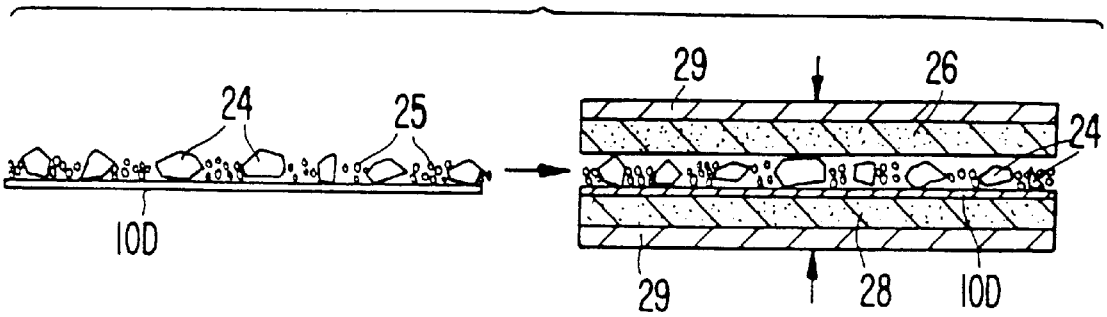
FIG. 5 is a schematic representation showing another method for fixing the particles in matrix material; and, FIGS. 6–8 are schematic views showing further modified methods for fixing the particles in matrix material.

FIG. 5 of the drawings illustrates another modification of the method discussed above. In FIG. 5, there is the substrate 10D which will have an adhesive on at least one surface. The surface may have a mesh-type material applied to it, as discussed above for the deposit of hard particles 24; then, the mesh-type material may be removed or not, as desired. In FIG. 5, the mesh-type material is not shown, but a mesh as in FIG. 4 may be used and left in place if desired. Then, a fusing material 25 may be placed on the substrate. Since the hard particles 24 are already in place, the fusing material 25 will fill the interstices. A small number of pieces of material 25 is shown in FIG. 5, but those skilled in the art will understand that a relatively fine powder may be used, and the material 25 will largely surround each of the particles 24.

The substrate 10D therefore has hard particles 24 distributed thereon, and fusing material 25 at least partially surrounding the hard particles 24, all adhered to the substrate 10D by the adhesive on the substrate. This substrate is then placed against a sinterable preform. As shown in FIG. 5, the substrate is sandwiched between two preforms, though only one can be used if desired, as in FIG. 4.

Plates 29 will exert pressure on the assembly of FIG. 5, and heat will be applied. The fusing material 25 will melt at or below the sintering temperature of the preforms 26 and 28, and will assist in adhering the particles 24 to one another, and to the preforms 26 and 28. As a result, the abrasive tool can be stronger; or, one can use cheaper preforms because of the superior adhesion, without depreciating the quality of the final abrasive material. As is well known in the art, if the hard particles 24 are buried under the surface of the matrix material, the working surface of the tool will be sand blasted or similarly treated to "open" the surface, or to expose the hard particles, before the first use.

In all of the above discussed methods, it should be understood that the substrate 10 can be virtually any mesh-type material, and including a preform. A preform may be coated with adhesive to act as the substrate; then, the step of placing the substrate against a preform is not a separate step, but is merged with the step of placing hard particles on the substrate.

Further, one might start with any substance, such as a piece of heat sensitive or pressure sensitive tape, film or the like and deposit powder or fibers of matrix material thereon. The surface of this material can then be coated with more adhesive, and the process repeated until a preform of the desired thickness is achieved. Adhesive can be the final layer, to receive and temporarily hold hard particles.

A sinterable preform with a high percentage porosity (e.g. 80% and above) can receive an adhesive substrate to seal one side of the preform. A fine, fusible powder is then poured into the preform to fill (at least partially) the pores of the preform. If desired, a second adhesive substrate can be used to seal the opposite side of the porous preform. The porous preform next receives a plurality of hard particles that are temporarily fixed to another adhesive substrate. A mesh-type material may also be adhered to this substrate. The substrates and preform are then placed together and sintered with pressure. It will of course be understood that one may also provide a preform on top of the layer of hard particles, so the hard particles are between the two preforms.

The preform for use in the present invention may be also include a plurality of hard particles therein. For example, some diamonds, cubic boron nitrides, crushed hard metal, such as cemented carbides, and ceramic pieces may be included and mixed with the metal powder or fibers of the preform. The preform may then be adhered with adhesive, partially sintered or sintered. The included hard particles will provide better resistance to abrasion to secure the hard particles 14, 19 or 24 and hold them more tenaciously.

By providing a preform with hard particles therein, one can then place a mesh-type material on at least one surface of the preform and apply compaction pressure. During compaction, some of the hard particles will be urged into some of the openings of the mesh material, thereby achieving a result similar to that described herein. While the abrasive material will not be as nearly homogeneous as the material formed by the other methods described herein, the technique is simple and could provide an inexpensive commercial product.

In all the above discussed embodiments of the invention, it will be understood by those skilled in the art that the materials may be impregnated with a fusible material. One will simply place a fusible material on at least one side of the assembly before beginning the heating and compaction, and the fusible material will melt and be carried into the material by capillary action.

Figure 6:
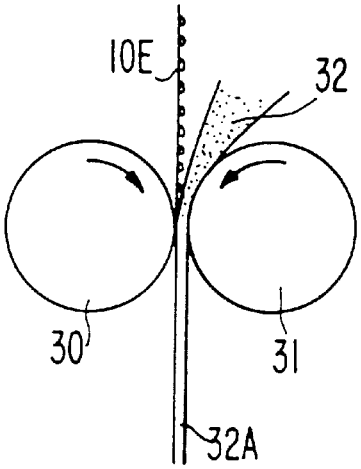
Figure 7:
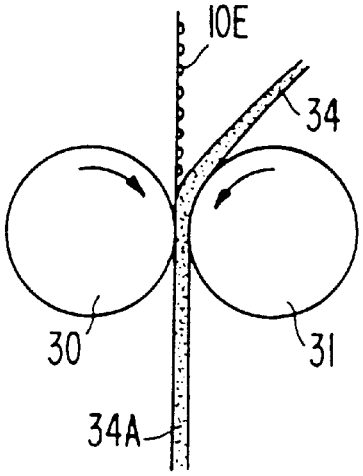
Figure 8:
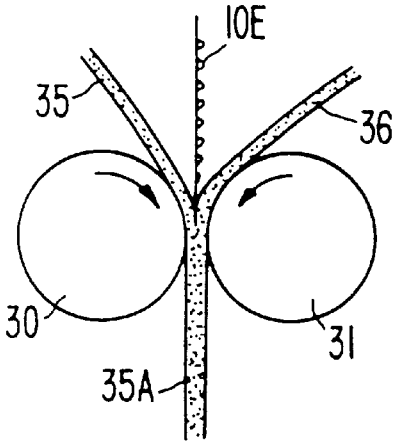

Looking now at FIGS. 6, 7 and 8, the above discussion of the methods should be kept in mind, and the compaction step is carried out by roll compaction. In FIGS. 6, 7 and 8 the apparatus is substantially the same, so all figures have the same reference numerals for similar parts.

In FIG. 6, a substrate 10E is fed between two rolls 30 and 31. The substrate 10E will be any of the substrates discussed above, with hard particles adhered within the openings of the substrate. To secure the particles in a sinterable matrix material, a metal powder or the like is added at 32. The assembly is compacted at the nip of the rolls 30 and 31 to produce the final product 32A. It should be understood that the powder 32 is a sinterable material, and may include hard particles as in discussed above.

FIG. 7 shows the substrate 10E passing between the rolls 30 and 31, and a preform 34 is placed against the substrate 10E. Pressure at the nip of the rolls 30 and 31 will provide the compaction step discussed to produce the final product at 34A. FIG. 8 is similar to FIG. 7, except that there are two preforms 35 and 36, one on each side of the substrate to produce a product similar to that produced by the method shown in FIG. 5. The product 35A exits from the nip of the rolls 30 and 31.

Thus, the method of the present invention is readily adapted to a continuous process for forming the abrasive material. A continuous strip of mesh-type substrate, which has a pressure sensitive adhesive tape, or a preform or the like coated with adhesive applied to it can be fed between compaction rolls 30 and 31. Matrix material in the form of powder or fibers can be fed against the substrate, or a preform can be fed in against the substrate to form the final product after sintering. The substrate and the matrix materials can be selected to provide a final product with the desired features.

It will therefore be understood by those skilled in the art that the particular embodiments of the invention here presented are by way of illustration only, and are meant to be in no way restrictive; therefore, numerous changes and modification may be made, and the full use of equivalents resorted to, without departing from the spirit or scope of the invention as outlined in the appended claims.

What is claimed is:

1. A method for making an abrasive material comprising the steps of adhering a pressure sensitive adhesive tape on one side of a mesh material substrate having a plurality of openings extending therethrough so that said pressure sensitive adhesive tape closes said openings on said one side of the substrate, applying at least one mask having a plurality of openings distributed in a predetermined pattern over the side of the substrate opposite the side to which the pressure sensitive tape is adhered, placing a quantity of hard particles through the openings in said mask and into exposed openings in said mesh material substrate to form a predetermined distributed pattern of said particles in said particles in said substrate corresponding to the pattern of the mask, wherein at least some of said particles in said exposed openings in said mesh material substrate adhere to said pressure sensitive tape, at least partially surrounding the particles that are adhered to said pressure sensitive adhesive tape with a sinterable matrix material, and heating said sinterable matrix material to cause said material to hold said particles in said pattern.

2. The method of claim 1, further including the step of removing hard particles that are not adhered to said pressure sensitive adhesive tape prior to the step of at least partially surrounding the particles that are adhered to said pressure sensitive adhesive tape with the sinterable matrix material.

3. The method of claim 1, further including the step of removing said at least one mask from said mesh material substrate prior to the step of at least partially surrounding said particles with a sinterable matrix material.

4. The method of claim 3, including the step of applying a meltable material to said mesh material substrate after said step of removing said mask and before the step of at least partially surrounding the particles with a sinterable matrix material.

5. The method of claim 4, wherein said meltable material is selected from the group consisting of fusible and brazable material.

6. The method of claim 1, further including the step of removing said at least one mesh material substrate prior to the step of heating said sinterable matrix material.

7. The method of claim 1, further including the step of removing said at least one mask and said mesh material substrate from said pressure sensitive adhesive tape prior to the step of at least partially surrounding the particles with a sinterable matrix material.

8. The method of claim 7, including the step of applying a meltable material to said pressure sensitive adhesive tape after the step of removing said at least one mask and said mesh material substrate from said pressure sensitive adhesive tape and before the step of at least partially surrounding the particles with a sinterable matrix material.

9. The method of claim 8, wherein said meltable material is selected from the group consisting of fusible and brazable material.

10. The method of claim 1, 3, or 7 further including the step of applying a supplementary force to said hard particles that adhere to said pressure sensitive adhesive tape before the step of at least partially surrounding the particles with a sinterable matrix material.

11. The method of claim 10, wherein said supplementary force is a mechanical force or a magnetic force.

12. The method of claim 10, wherein said particles are of such a size as to protrude from said openings in said mesh material substrate.

13. The method of claim 12, wherein said supplementary force is a mechanical force or a magnetic force.

14. The method of claim 1, wherein said step of at least partially surrounding the particles that adhere to said pressure sensitive adhesive tape with a sinterable matrix material includes placing a sinterable preform of sinterable matrix material against at least one of said pressure sensitive adhesive tape or said mask to form an assembly and thereafter applying pressure to said assembly to urge said perform, tape, mesh material substrate, mask, and particles together.

15. The method of claim 11, wherein said pressure is applied to said assembly prior to the step of heating said sinterable matrix material.

16. The method of claim 14, wherein said pressure is applied to said assembly during the step of heating said sinterable matrix material.

17. The method of claim 14, wherein said sinterable preform has hard particles randomly distributed therein.

18. The method of claim 14, wherein said perform is made by coating an adhesive tape with a sinterable matrix material for providing a first layer of a sinterable matrix material, and coating the surface of said first layer of sinterable matrix material with an adhesive and then applying a second layer of sinterable matrix material on the adhesive, and repeating said steps until said perform of the desired thickness is formed.

19. The method of claim 14, wherein said perform is made by providing a substrate with an adhesive surface, then coating said adhesive surface with a sinterable matrix material for providing a first layer of a sinterable matrix material, and coating the surface of said first layer of sinterable matrix material with an adhesive and then applying a second layer of sinterable matrix material on the adhesive, and repeating said steps until said perform of the desired thickness is formed.

20. The method of claim 14, wherein said perform is a fusible powder containing preform of sinterable matrix material and is made by sealing one side of a porous sinterable preform with an adhesive material and then depositing a quantity of fusible powder into said porous preform.

21. The method of claim 3, wherein said step of at least partially surrounding the particles that adhere to said pressure sensitive adhesive tape with a sinterable matrix material includes placing a sinterable preform of sinterable matrix material against at least one of said pressure sensitive adhesive tape or said mesh material substrate to form an assembly and thereafter applying pressure to said assembly to urge said preform, tape, mesh material substrate, and particles together.

22. The method of claim 21, wherein said pressure is applied to said assembly prior to the step of heating said sinterable matrix material.

23. The method of claim 21, wherein said pressure is applied to said assembly during the step of heating said sinterable matrix material.

24. The method of claim 21, wherein said sinterable preform has hard particles randomly distributed therein.

25. The method of claim 21, wherein said preform is made by coating an adhesive tape with a sinterable matrix material for providing a first layer of a sinterable matrix material, and coating the surface of said first layer of sinterable matrix material with an adhesive and then applying a second layer of sinterable matrix material on the adhesive, and repeating said steps until said preform of the desired thickness is formed.

26. The method of claim 21, wherein said preform is made by providing a substrate with an adhesive surface, then coating said adhesive surface with a sinterable matrix material for providing a first layer of a sinterable matrix material, and coating the surface of said first layer of sinterable matrix material with an adhesive and then applying a second layer of sinterable matrix material on the adhesive, and repeating said steps until said preform of the desired thickness is formed.

27. The method of claim 21, wherein said preform is a fusible powder containing preform of sinterable matrix material and is made by sealing one side of a porous sinterable preform with an adhesive material and then depositing a quantity of fusible powder into said porous preform.

28. The method of claim 7, wherein said step of at least partially surrounding the particles that adhere to said pressure sensitive adhesive tape with a sinterable matrix material includes placing a sinterable preform of sinterable matrix material against at least one side of said pressure sensitive adhesive tape to form an assembly and thereafter applying pressure to said assembly to urge said preform, tape, and particles together.

29. The method of claim 28, wherein said pressure is applied to said assembly prior to the step of heating said sinterable matrix material.

30. The method of claim 28, wherein said pressure is applied to said assembly during the step of heating said sinterable matrix material.

31. The method of claim 28, wherein said sinterable preform has hard particles randomly distributed therein.

32. The method of claim 28, wherein said preform is made by coating an adhesive tape with a sinterable matrix material for providing a first layer of a sinterable matrix material, and coating the surface of said first layer of sinterable matrix material with an adhesive and then applying a second layer of sinterable matrix material on the adhesive, and repeating said steps until said preform of the desired thickness is formed.

33. The method of claim 28, wherein said preform is made by providing a substrate with an adhesive surface, then coating said adhesive surface with a sinterable matrix material for providing a first layer of a sinterable matrix material, and coating the surface of said first layer of sinterable matrix material with an adhesive and then applying a second layer of sinterable matrix material on the adhesive, and repeating said steps until said preform of the desired thickness is formed.

34. The method of claim 28, wherein said preform is a fusible powder containing preform of sinterable matrix material and is made by sealing one side of a porous sinterable preform with an adhesive material and then depostiing a quantity of fusible powder into said porous preform.

35. The method of claim 1, 3, or 7, wherein said mesh material substrate is formed of a polymeric or low melting metallic material.

36. The method of claim 35, wherein said mesh material substrate evaporates or is at least partially dissolved in the sinterable matrix material during heating.

37. The method of claim 1, 3, or 7, wherein the mesh material substrate is a wire mesh.

38. The method of claim 1, 3, or 7, wherein said hard particles are selected from the group consisting of diamonds, carbides, borides, nitrides, pieces of hard metals, pieces of ceramic, and mixtures thereof.

39. The method of claim 1, wherein the pressure sensitive adhesive tape, the mesh material substrate with the particles in the openings thereof, the mask, and the surrounding sinterable matrix material are compacted under pressure prior to said step of heating said matrix material.

40. The method of claim 3, wherein the pressure sensitive adhesive tape, the mesh material substrate with the particles in the openings thereof and the surrounding sinterable matrix are compared under pressure prior to the step fo heating said matrix material.

41. The method of claim 7, wherein the pressure sensitive adhesive tape, the particles adhered to the pressure sensitive adhesive tape and the surrounding sinterable matrix material are compacted under pressure prior to the step of heating said matrix material.

42. The method of claim 1, 3, or 7 wherein pressure is applied to said sinterable matrix material during the step of heating said sinterable matrix material.

43. The method of claim 1 or 3, wherein the heating of the sinterable matrix material forms a composite abrasive material of the matrix material with said particles in said pattern and with the mesh material substrate.

44. The method of claim 1 or 3 wherein the mesh material substrate is a preform of sinterable matrix material.

45. The method of claim 1, wherein said mesh material substrate and said pressure sensitive adhesive tape are in the form of continuous strips, and wherein the step of adhering the pressure sensitive adhesive tape against one side of the mesh material substrate is accomplished by feeding said continuous strips of mesh material substrate and pressure sensitive adhesive tape between opposed compressing means.

46. The method of claim 45, wherein the step of at least partially surrounding said hard particles that are adhered to said pressure sensitive adhesive tape with a sinterable matrix material comprises feeding a sinterable preform between compressing means along with said mesh material substrate, said mask, and pressure sensitive adhesive tape after having said hard particles have been placed in said openings in said mesh material substrate.

47. The method of claim 3, wherein said mesh material substrate and said pressure sensitive adhesive tape are in the form of continuous strips, and wherein the step of adhering the pressure sensitive adhesive tape against one side of the mesh material substrate is accomplished by feeding said continuous strips of mesh material substrate and pressure sensitive adhesive tape between opposed compressing means.

48. The method of claim 47, wherein the step of at least partially surrrounding said hard particles that are adhered to said pressure sensitive adhesive tape with a sinterable matrix material comprises feeding a sinterable preform between compressing means along with said mesh material substrate and pressure sensitive adhesive tape after having said hard particles have been placed in said openings in said mesh material substrate and said mask removed.

49. A method for making an abrasive material comprising the steps of adhering a pressure sensitive adhesive tape to selected areas of one side of a mesh material substrate having a plurality of openings extending therethrough so that said pressure sensitive adhesive tape closes said openings in said selected areas on said one side of the substrate, placing a quantity of hard particles into at least some of the openings in the selected areas of the mesh material substrate to form a predetermined distributed pattern of said particles in said substrate, wherein at least some of said particles in said openings in said selected areas of said mesh material substrate adhere to said pressure sensitive adhesive tape, at least partially surrounding the particles that are adhered to said pressure sensitive tape with a sinterable matrix material, and heating said sinterable matrix material to cause said material to hold said particles in said pattern.

50. The method of claim 49, further including the step of removing hard particles that are not adhered to said pressure sensitive adhesive tape prior to the step of at least partially surrounding the particles that are adhered to the said pressure sensitive adhesive tape with the sinterable matrix material.

51. The method of claim 49, further including the step of applying a mask having a plurality of openings distributed in a predetermined pattern over the side of the substrate opposite the side to which the pressure sensitive adhesive tape is adhered before the hard particles are placed in the openings of the mesh material substrate.

52. The method of claim 51, further including the step of removing said mask prior to the said step of at least partially surrounding said particles in said openings with a sinterable matrix material.

53. The method of claim 49, 51 or 52 wherein the mesh material substrate is a wire mesh.

54. The method of claim 51 or 52, wherein the mask is a wire mesh.

55. The method of claim 49, wherein said step of at least partially surrounding the particles that adhere to said pressure sensitive adhesive tape with a sinterable matrix material includes placing a sinterable preform of sinterable matrix material against at least one of said one side of the substrate to which the pressure sensitive adhesive tape is applied or said mesh material substrate to form an assembly and thereafter applying pressure to said assembly to urge said preform, tape, mesh material substrate, and particles together.

56. The method of claim 55, wherein said pressure is applied to said assembly prior to the step of heating said sinterable matrix material.

57. The method of claim 55, wherein said pressure is applied to said assembly during the step of heating said sinterable matrix material.

58. The method of claim 55, wherein said sinterable preform has hard particles randomly distributed therein.

59. The method of claim 49, wherein said mesh material substrate is formed of a polymeric or low melting metallic material.

60. The method of claim 59, wherein said mesh material substrate evaporates or is at least partially dissolved in the sinterable matrix material during heating.

61. The method of claim 49, wherein the pressure sensitive adhesive tape, the mesh material substrate with the particles in the opening thereof that are adhered to the pressure sensitive adhesive tape and the surrounding sinterable matrix material are compacted under pressure prior to the step of heating said matrix material.

62. The method of claim 49, wherein the mesh material substrate is a preform of sinterable matrix material.

* * * * *

UNITED STATES PATENT AND TRADEMARK OFFICE

CERTIFICATE OF CORRECTION

PATENT NO. : 5,980,678
DATED : November 9, 1999
INVENTOR(S) : Naum N. Tselesin

It is certified that error appears in the above-identified patent and that said Letters Patent is hereby corrected as shown below:

Sheet 1 of 2, FIG. 2, numeral "14" should read numeral --13--.

Claim 15, Column 8,
Line 52, "claim 11" should read --claim 14--.

Signed and Sealed this

Third Day of July, 2001

Nicholas P. Godici

*Attest:*

*Attesting Officer*

NICHOLAS P. GODICI
*Acting Director of the United States Patent and Trademark Office*